United States Patent [19]

Takenoya et al.

[11] Patent Number: 4,649,845

[45] Date of Patent: Mar. 17, 1987

[54] STITCHING PATTERNS FOR ADJUSTING FEED AMOUNT IN AN ELECTRONIC CONTROL SEWING MACHINE

[75] Inventors: Hideaki Takenoya; Eiichi Syomura, both of Tokyo; Mikio Inamori, Tama, all of Japan

[73] Assignee: Janome Sewing Machine Co. Ltd., Tokyo, Japan

[21] Appl. No.: 672,378

[22] Filed: Apr. 9, 1984

[30] Foreign Application Priority Data

Apr. 7, 1983 [JP] Japan ..... 58-50823[U]

[51] Int. Cl.[4] ..... D05C 17/00

[52] U.S. Cl. ..... 112/439; 112/266.1; 112/453

[58] Field of Search ..... 112/439, 266.1, 451, 112/453, 456, 458, 316, 317, 314, 78, 403, 409, 429; 2/244, 246

[56] References Cited

U.S. PATENT DOCUMENTS

| | | | |
|---|---|---|---|
| 4,343,249 | 8/1982 | Takenoya et al. | 112/453 X |
| 4,457,246 | 7/1984 | Hanyu et al. | 112/266.1 |
| 4,561,369 | 12/1985 | Meier | 112/439 X |

*Primary Examiner*—Peter Nerbun

*Attorney, Agent, or Firm*—Michael J. Striker

[57] ABSTRACT

A specific pattern for adjusting a fabric feeding amount in an electronic sewing machine with a storage for storing stitch control data for a plurality of different patterns. The specific pattern includes a 1st stitching group stored in the sewing machine and used for stitching the whole pattern in a reverse feed, a 2nd stitching group which coincide with the first one when a feed reference point is adjusted properly, and at least a 3rd stitching group which is stitched by a plurality of forward feeds and rearward feeds and is positioned in opposition to the 1st stitching group relative to a middle basic line, and gives to the 2nd stitching group accumulative errors of the forward feed and the rearward feed, so that a balance between the feeding amounts in a forward and a rearward directions of stitching is conformed.

4 Claims, 7 Drawing Figures

STITCHING PATTERNS FOR ADJUSTING FEED AMOUNT IN AN ELECTRONIC CONTROL SEWING MACHINE

BACKGROUND OF THE INVENTION

FIELD OF THE INVENTION

The present invention relates to an electronic sewing machine, and more particularly to a stitch pattern to be sewn to adjust the balance of fabric feeding amounts in the forward and rearward directions. With the development of an electronic memory for computer sewing machines which may store almost limitless amount of the data, it has become possible to stitch any patterns including very complicated patterns of a large number of the stitches formed in the forward and rearward fabric feeding directions such as alphabet letters, the images of flowers and animals etc.

The electronic control sewing machine usually stores, as pattern signals, a needle amplitude amount and a fabric feed amount for stitches which form patterns, and transmits said pattern signals to an amplitude control motor and a feed control motor. In this kind of sewing machine, a physical space within the mechanism for producing the patterns has more problems as the conventional pattern generation due to cams housed in the mechanical structure of the sewing machine. Therefore, it is possible to freely increase the number of the patterns stored in the sewing machine and the stitching number of the individual patterns. As a result various fine patterns or complicated patterns have been produced.

The mechanism of the electronic control sewing machine controls the forward feed and the rearward feed by reverse rotations around the control of the feed amount "0" of the feed control motor. The respective members of the feed control mechanism have manufacturing tolerances, so that a value of a signal indicative of the feed amount and an actual feed amount are more or less different.

Sewing machines were manufactured, where respective members of the feed control mechanisms were within the manufacturing tolerances. After their feed reference points have been adjusted, the actual feeding amounts were measured for the values of the signals of the feed amounts, and the relation therebetween was standardized, as shown in FIG. 1, in accordance with the measuring data.

As shown in FIG. 1, the broken line indicates that the feeding amounts and the feeding signals are in proportion 1:1 as desired both in the forward and rearward feeding directions. However, in the actual mechanism, the fabric feed reference point is to be usually unstable and is inevitably determined at a point on the lateral axis which is more or less spaced from the center 0. Thus if the feed reference point is once determined at a place other than the center 0, for example, on the plus side of the lateral axis, the forward feeding amounts will be constant with the respective feeding signals, but the rearward feeding amounts will be remarkably different from the forward feeding amounts even though the former may be constant in the rearward direction. This will considerably deform the patterns of the stitches formed with both the forward and rearward feeding amounts. In order to form the stitches of the same feeding amounts in the rearward feeding direction with the stitches of the feeding amounts in the forward feeding direction, it is necessary to displace the fabric feeding reference point to a place on the minus side of the lateral axis from the place on the plus side at the same distance from the center 0 as shown by solid lines in FIG. 1. Such a displacement of the feeding reference point is required each time the fabric feeding direction is changed during the sewing of a pattern.

Since the number of the patterns stored in the sewing machine and the stitching number of the pattern are increased, a first problem resides in that the existing adjustment is insufficient to regulate the feed reference point, and a second problem is that the existing pattern designing results in a big difference in shape between the data and the actual stitching pattern, and this fact could not be ignored.

The second problem could be solved in designing. That is, in the conventional method, the pattern was not stitched as requested by the signal as shown in FIG. 1, and such a difference was ignored. A model pattern was prepared as being stitched along the dotted line shown, and the feed amount signal was decided.

If the model pattern is simple and the stitching number is not many in the initial period of operation, the difference between the model pattern and the shape of the stitching pattern is not outstanding. However, as the stitching number increases and the model pattern becomes complicated, the difference between the feed signal value and the actual feed amount influences finished products.

This problem may be solved by distinguishing the signal in accordance with the standardized solid line in FIG. 1 from the model pattern when making the pattern data, and arranging that the model pattern and the stitching pattern be practically made of the same shape.

The standardization means such an operation which, in order to provide the same shape practically as described above, decides the quantitative relation between the value of the signal of the feeding amount and the actual feeding amount. In other words, the standardization means the operation which obtains relation between the measuring data of the actual feeding data and the value of the signal of said amount by a sort of a weighted average operation.

An outline of the feed control mechanism will be mentioned for explaining the above-mentioned first problem. The feed control mechanism especially controls the feed control motor in the forward feed and the rearward feed by rotations opposite to each other around the feeding amount "0". The feed control mechanism is, in a transmission path of the feed controlling amount, provided with a first feed controller for adjusting the feed reference point when the sewing machine is set up at the maker's side, and with a second feed controller which is set under the neutral condition of the operation when adjusting the feed reference point, and which may be operated from the outside of the sewing machine.

With respect to the adjustment of the feed reference point when the sewing machine is set up and regulated, the feed reference point is adjusted by operating the first feed controller. For this aim, the curve of the feeding amount as shown in FIG. 1 is determined for each of the sewing machines. Since it takes a long time for calculating the feed reference point, the feed control motor is firstly energized at the signal value "0" of the feed amount, and the actual feeding amount is set to be "0" by operating the first feed controller. However, since the actual feeding amount "0" has a width along the lateral axis as shown in FIG. 1, the controlling is still rough. Secondly several kinds of representative patterns are stitched, and the first feed controller is operated while observing finished stitches.

The representative pattern is such a pattern which is outstanding out of regularity if the feed refernce point is not correctly adjusted. A tulip pattern as one example is shown in FIG. 2. With respect to the figures 0, 15, 30 in the same, the full amplitude is equally divided into 30 parts and amplitude cordinates are set as 0, 1, 2, . . . 30 from the right. 0 is a right basic line, 15 is a middle basic line and 30 is a left basic line. The figure belonging to the pattern indicates a stitching number counting from a 1st stitch of an initial one. In this example, a discriminating portion is a distance between the stitches combining the 11th stitch—the 12th stitch and the stitches combining the 22nd stitch—the 23rd stitch. Since this distance is widened or draws "X" by crossing the threads, the adjusting condition of the feed can be discriminated while stitching the tulip pattern. However, 10 stitches are between the 12th stitch and the 22nd stitch, and these stitches determine the thickness of the tulip stem. As far as the electronic sewing machine forms simple patterns with lesser stitching number, there are not any special problems in the adjustment while stitching said representative pattern. The stitching number of individual patterns stored in the sewing machine has been increased, and the stitches of letters, characters or fine abstract patterns have been formed. Representative patterns have not been inherently prepared for adjusting the feed reference point. For abstract patterns, the shapes of patterns should be necessarily decided, taking aesthetic elements into consideration, and the abstract patterns may be used as the accidential result to regulate the feed reference point. The stitching number has not been sufficient for discriminating the adjusting condition of the feed reference point.

In the adjustment while stitching the representative patterns as conventionally, since the patterns are stored within the sewing machine, the stitched pattern is fed forward and under a presser foot, and fed in succession backward of the presser foot. Therefore, several patterns are stitched which are more in stitching number than the existing ones, otherwise the pattern is stitched and pulled out while stopping the sewing machine so as to discriminate the stitching condition by the present adjustment. It takes a long time for regulation.

Similar problems arise at the customers' sides where the adjustment of the feed reference point has been finished, but the balance between the forward feed and the rearward feed is temporally irregular due to quality of the fabric used or others.

SUMMARY OF THE INVENTION

It is an object of the present invention is to provide patterns for adjusting a feeding amount of the electronic control sewing machine.

This and other objects of the invention are attained by a specific pattern stitched for adjusting a fabric feeding amount of an electronic sewing machine storing stitch control data for a plurality of different patterns and having a needle swingable within a predetermined laterally extended range and a fabric feeding device, said needle and fabric feeding device being controlled by said stitch control data to produce various stitch patterns within said predetermined range defined by a first end needle position, a second end needle position and an intermediate needle position, and having an adjusting device operated to adjust the fabric feeding amount which is determined by said fabric feeding device controlled by said stitch control data in forward and rearward feeding directions, said specific pattern comprising:

(a) a first group of stitches produced substantially at one of said first and second end needle positions of said predetermined range;

(b) a second group of stitches produced between said one end needle position and said intermediate needle position of said predetermined range;

(c) a third group of stitches produced between said intermediate needle position and the other of said first and second end needle positions, said third group of stitches including stitches produced in the forward and rearward feeding directions and frequently and commonly used in a plurality of different patterns stored in the sewing machine; and (d) a fourth group of stitches produced between said intermediate needle position and said one end needle position, so as to be positionally compared with said second group of stitches for conformation of a balance between the feeding amounts in a forward and rearward feeding directions.

DETAILED DESCRIPTION OF THE PREFERRED EMBODIMENTS

Figure 3:
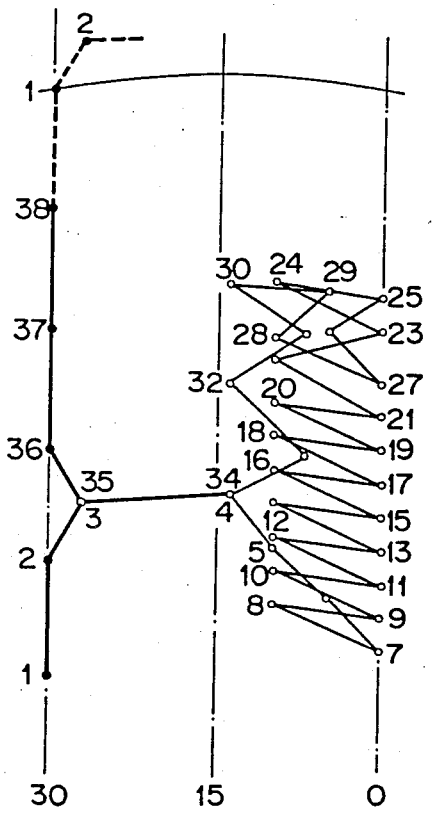
FIG. 3 is a view showing a pattern adjusting the feeding amount in accordance with an embodiment of the invention.

The present invention will be explained in reference to the embodiment shown in the attached drawings. FIG. 3 shows a pattern for adjusting the feeding amount. With respect to the figures 0, 15, 30 in FIG. 3, the full feed amplitude is equally divided into 30 parts and amplitude cordinates are set as 0, 1, 2, . . . 30 from the right. 0 is a right basic line, 15 is a middle basic line and 30 is a left basic line.

The pattern for adjusting the feeding amount comprises a 1st stitching group for stitching whole patterns in the reverse feed, a 2nd stitching group which coincides when the adjustment of the feed reference point is proper, and a 3rd stitching group which is formed with a plurality of the forward feed and rearward feed stitches, and is positioned in opposition to the 1st stitching group relative to the middle basic line, and gives to the second stitching group accumulative errors of the forward feed and the rearward feed.

In the present embodiment, the 1st stitching group is composed of the 1st stitch, and 2nd stitch, and the 36th to 38th stitches, and is for stitching the whole pattern with the reverse feed. The 36th to 38th stitches are formed after the 2nd and 3rd stitching groups have been formed.

Figure 4:
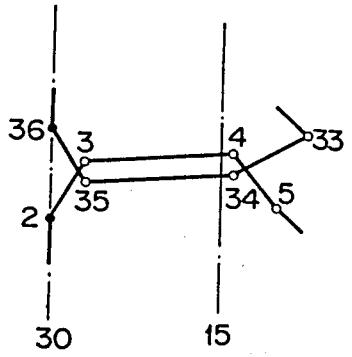
FIGS. 4 and 5 are views showing examples of positioning relations in a 2nd stitching group of the patterns adjusting the feeding amount during adjusting the feed reference point.
Figure 5:
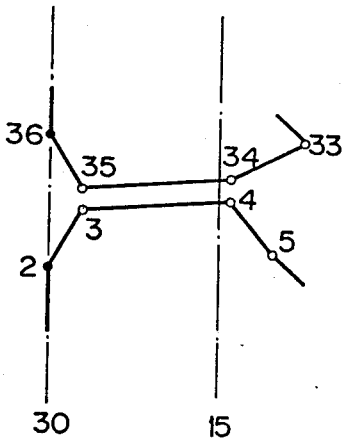

The 3rd stitch and the 35th stitch, and the 4th stitch and the 34th stitch coincide in the signals, respectively, and form said 2nd stitching group. If the feed reference point were not adjusted properly, the thread between the 3rd and 4th stitches and that between the 34th and the 35th stitches would be crossed with as shown in FIG. 4, or reversely open as shown in FIG. 5. Since four threads before and after these stitching threads are connected not at the right angle but in obliquity, they are easily observed, and the feed reference point may be easily regulated by discriminating it. The distance between the 2nd stitching group and the 4th stitch and the 34 stitch is combined by the 3rd stitching group composed of a plurality of stitches formed with a plurality of the forward feeds and rearward feeds. In the present embodiment, the feeds of 30 times (30 stitches) are carried out by means of the 3rd stitching group from the feed after the 4th stitch to the feed after the 33rd stitch. If the feed reference point were not proper, the accumulative errors of the forward feed and the rearward feed stitches would be given to the 2nd stitching group, As mentioned above, the stitching numbers of the patterns have been increased, and the stitchings of the letters or fine abstract patterns have been formed, and these stitching numbers exceed 40 to 100 stitches.

Patterns which are outstanding in irregularity of the pattern shape form the stitching group corresponding to the 3rd stitching group in the patterns for adjusting the feeding amount, and are such patterns having the stitching group corresponding to the connected 2nd stitching group. In these patterns, the stitching numbers forming the stitching group corresponding to the 3rd stitching group, are often merely parts of all the stitching numbers of the patterns, and stitching patterns corresponding to said parts may be designed. The feed is adjusted at high precision for the pattern which has the maximum of the stitching number forming the stitching group corresponding to the 3rd stitching group, and the 30 stitches of the 3rd stitching group of the pattern for adjusting the feed reference point are determined in order not to make the patterns irregular.

Figure 6:
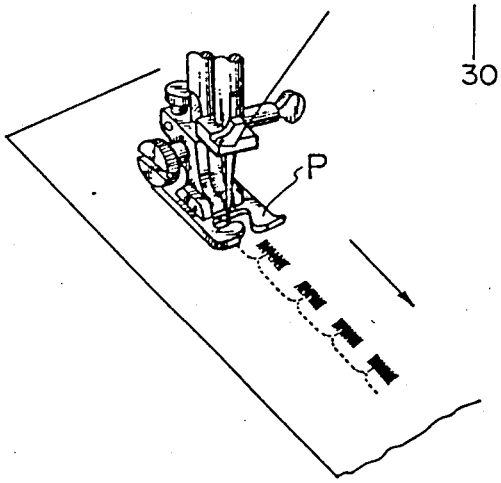
FIG. 6 is a view showing stitches of the pattern adjusting the feeding amount.

The pattern for adjusting the feeding amount according to the invention is stitched with the reverse feed, differently from other patterns, so that the stitched pattern is not positioned under the presser foot (P) as shown in FIG. 6, and is fed towards the operator in succession. Therefore, the feed reference point is adjusted while the pattern is stitched.

Figure 7:
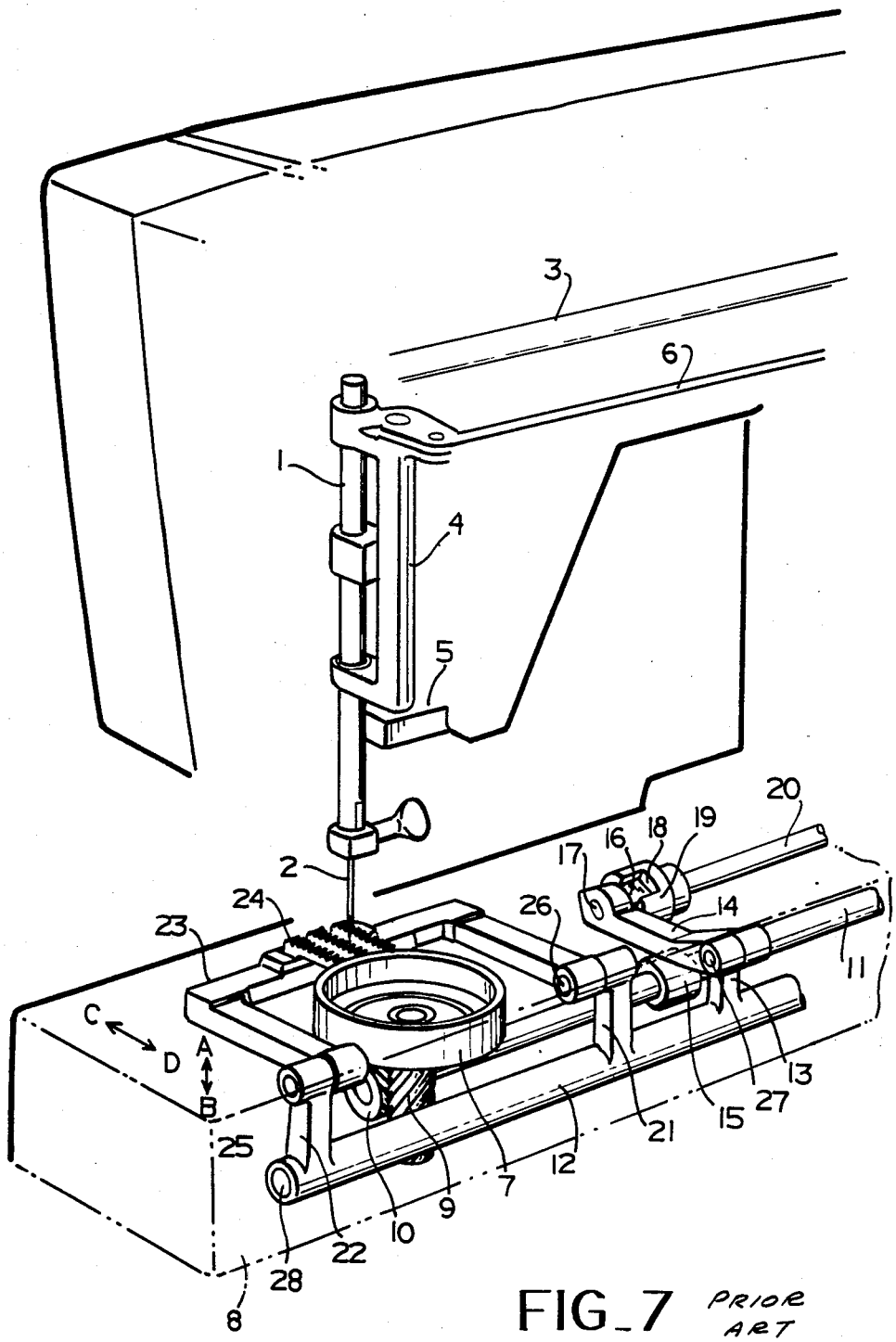
FIG 7 PRIOR ART
FIG. 7 is a partial perspective view of the conventional sewing machine for producing a pattern according to the invention.

With reference to FIG. 7 it will be seen that a needle bar 1 having a needle 2 secured to the lower end thereof is operatively connected to an upper drive shaft 3 of the sewing machine and is vertically reciprocated by rotation of the upper drive shaft.

The needle bar 1 is supported on a swingable frame 4 which is swingably mounted on a machine housing 5 and is connected, through a rod 6, to an actuator such as a stepping motor (not shown) which is operated by selected stitch control data for a stitch pattern to control the swinging amplitude of the needle within a predetermined laterally extended range.

A loop taker 7 is rotatably arranged in an arm bed 8 and has a worm gear 9 which is in engagement with a gear 10 which is secured to a lower drive shaft 11 which is operatively connected to the upper drive shaft 3.

The lower drive shaft 11 is rotated in association with the rotation of the upper drive shaft 3 to rotate the loop taker 7 in timed relation with the vertical reciprocation of the needle 2.

A rocking member 12 is roackably arranged in the arm bed 8, and it has a vertical arm 13 pivotably supporting a U-shaped cam follower 14 which is in engagement with a cam 15 secured to the lower drive shaft 11 for rotation therewith.

The U-shaped cam follower 14 has a free end having a small block 16 pivoted thereto by a pin 17. The block 16 is in sliding engagement with a groove 18 of a feed regulator 19 which is connected through a shaft 20 to an actuator such as a stepping motor (not shown) which is operated by selected stitch control data for a stitch pattern to control the angular position of the feed regulator 19 while the selected pattern is stitched.

Further the rocking arm 12 has vertical arms 21, 22 which pivotally support a feeding frame 23 having a set of feed dogs 24. The feeding frame 23 is swingingly moved up and down as shown by arrows A and B by a cam (not shown) around pivots 25, 26 while the sewing machine is driven.

When the lower drive shaft 11 is rotated, the cam 15 is rotated to swingingly move the U-shaped cam follower 14 up and down around the pivot 27. Since the block 16 of the cam follower 14 is in sliding engagement with the groove 18 of the feed regulator 19, the vertical swinging movement of the cam follower 14 is changed into a reciprocation in a horizontal plane as shown by arrows C and D. The amount of the horizontal reciprocation is varied in dependence upon the angular positions of the feed regulator 19.

Therefore, the rocking member 12 is rocked around a pivot 28, and accordingly the feeding frame 23 is reciprocatingly moved in the horizontal plane as shown by the arrows C and D while the feeding frame 23 is swingably moved up and down as shown by the arrows A and B.

It is therefore apparent that the fabric feeding amount resulted by the feed dogs 24 and the fabric feeding direction are variable in dependence upon the angular positions of the feed regulator 19.

Herein, the explanation will be made to the adjustment of the feed reference point while stitching the pattern for adjusting the feeding amount. The feed control mechanism especially controls the feed control motor during the forward feed and the rearward feed by rotations opposite directions relative to the feeding amount reference "0". The feed control mechanism is, in a transmission path of the feed controlling amount, provided with a first feed controller for adjusting the feed reference point when the sewing machine is set up at the maker's side, and with a second feed controller which is set under the neutral condition of the operation when adjusting the feed reference point, and which may be operated from the outside of the sewing machine.

Figure 1:
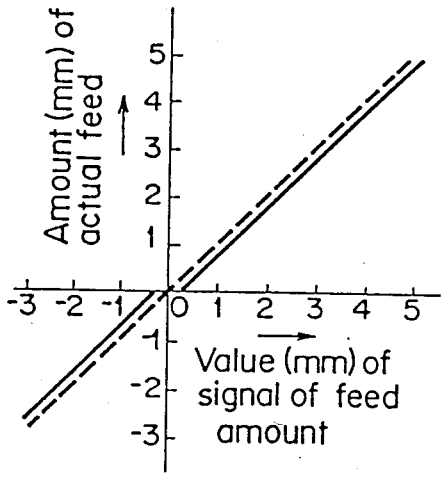
FIG. 1 is a graph showing a standardized relation between values of signals indicative of the feeding amount and the actual feeding amount.
Figure 2:
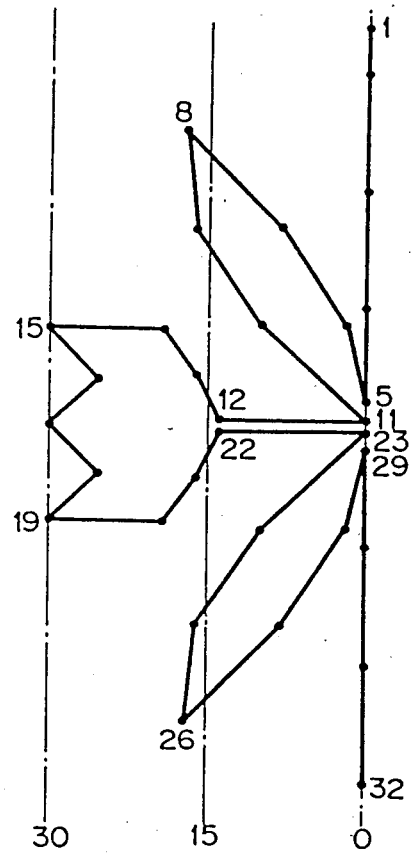
FIG. 2 is a view showing one example of a representative stitching pattern stored in the sewing machine and used for adjusting the feed reference point according to the prior art.

With respect to the adjustment of the feed reference point when the sewing machine is set up and adjusted, the feed reference point is adjusted by operating the first feed controller. For this purpose, the curve of the feeding amount as shown in FIG. 1 is defined for each of sewing machine. Since it takes a long time for calculating the feed reference point, the feed control motor is firstly energized at the signal value "0" of the feed amount, and the actual feeding amount is set to be "0" by operating the first feed controller. However, since the actual feeding amount "0" has a certain width along the lateral axis, as shown in FIG. 1, the controlling is still rough. Secondly several kinds of representative patterns are stitched, and the first feed controller is operated while observing finished stitches thereof.

Since the 3rd stitching group is composed of 30 stitches, the discrimination is highly precise and accordingly the feed reference point is adjusted at high precision.

The pattern for adjusting the feeding amount of the invention is stitched with the reverse feed, differently from other patterns, so that the stitched pattern is not positioned under the presser foot (P) as shown in FIG. 6, and is fed towards the operator in succession.

It will be understood that each of the elements described above, or two or more together, may also find a useful application in other types of specific patterns for adjusting a fabric feeding amount differing from the types described above.

While the invention has been illustrated and described as embodied in a specific pattern for adjusting a fabric feeding amount, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A specific pattern stitched for adjusting a fabric feeding amount of an electronic sewing machine storing stitch control data for a plurality of different patterns and having a needle swingable within a predetermined laterally extended range, and a fabric feeding device, said needle and fabric feeding device being controlled by said stitch control data to produce various stitch patterns within said predetermined range defined by a first end needle position, a second end needle position and an intermediate needle position, and also having an adjusting device operated to adjust the fabric feeding amount which is determined by said fabric feeding device controlled by said stitch control data in forward and rearward feeding directions, said specific pattern comprising:

(a) a first group of stitches (1–3 or 38–35) produced substantially at one of said first and second end needle positions of said predetermined range;

(b) a second group of stitches (3–4 or 35–34) produced between said one end needle position and said intermediate needle position of said predetermined range;

(c) a third group of stitches (4–34 or 34–4) produced between said intermediate needle position and the other of said first and second end needle positions, said third group of stitches including stitches produced in the forward and rearward feeding directions and frequently and commonly used in a plurality of different patterns stored in the sewing machine; and (d) a fourth group of stitches (4–3or 34–35) produced between said intermediate needle position and said one end needle position, so as to be positionally compared with said second group of stitches (3–4 or 35–34) for conformation of a balance between the feeding amounts in the forward and rearward feeding directions.

2. A specific pattern as defined in claim 1, wherein said first group of stitches (1–3) are produced in the rearward feeding direction.

3. A specific pattern as defined in claim 1, wherein said first group stitches (38–35) are produced in the forward feeding direction.

4. A specific pattern as defined in claim 1, wherein said second and fourth groups of stitches (3–4 or 35–34; 4–3 or 34–35) are produced with the fabric feeding nullified.

* * * * *